US008960734B2

(12) United States Patent
Camp

(10) Patent No.: US 8,960,734 B2
(45) Date of Patent: Feb. 24, 2015

(54) PUSH RESPONSIVE HOLD-DOWN

(76) Inventor: Robert Camp, Mesquite, TX (US)

( * ) Notice: Subject to any disclaimer, the term of this patent is extended or adjusted under 35 U.S.C. 154(b) by 162 days.

(21) Appl. No.: 13/475,861

(22) Filed: May 18, 2012

(65) Prior Publication Data

US 2013/0307280 A1 Nov. 21, 2013

(51) Int. Cl.
*E05C 1/02* (2006.01)

(52) U.S. Cl.
USPC ..... 292/193; 292/228; 292/DIG. 37

(58) Field of Classification Search
USPC ..... 292/193, 228, DIG. 37
See application file for complete search history.

(56) References Cited

U.S. PATENT DOCUMENTS 3,233,496 A * 2/1966 Frick et al. ..... 411/348
3,914,965 A * 10/1975 Paxton ..... 70/34
4,614,097 A * 9/1986 Signorelli ..... 70/34
4,848,196 A * 7/1989 Roberts ..... 81/177.85
5,494,323 A * 2/1996 Huang ..... 292/252
5,542,150 A * 8/1996 Tu ..... 16/113.1
5,594,974 A * 1/1997 Wattron et al. ..... 16/30
5,829,280 A * 11/1998 Chen ..... 70/49
5,997,056 A * 12/1999 Yamagishi ..... 292/341.17
6,077,011 A * 6/2000 Walker ..... 411/348

* cited by examiner

*Primary Examiner* — Mark Williams
(74) *Attorney, Agent, or Firm* — James A. Italia; Italia IP

(57) ABSTRACT

A latch which for example may secure a closure to an associated receptacle. The latch may comprise a collar which entraps the enlarged head of a large headed object. The collar may have a series of passages formed therein, each of which receives a spherical object such as a ball bearing. The latch may comprise a pushbutton having an annular body bearing a first portion which prevents the ball bearings from moving, and a second portion which gives each ball bearing space to occupy. The ball bearings normally interfere with the enlarged head and entrap the same within the collar. When the pushbutton is depressed, the second portion allows the ball bearings to move out of the interference position, thereby enabling the enlarged head to escape from the collar. Motion of the pushbutton also provides actuating force for moving the ball bearings.

22 Claims, 5 Drawing Sheets

PUSH RESPONSIVE HOLD-DOWN

CROSS-REFERENCE TO RELATED APPLICATION

This application claims priority to U.S. patent application Ser. No. 12/408,929, filed Mar. 23, 2009.

FIELD OF THE INVENTION

The present invention relates to devices for coupling one object to another, and more particularly to a latching mechanism particularly suitable for latching one object to an underlying object, which latching mechanism may operate in pushbutton fashion to release the latched object.

BACKGROUND OF THE INVENTION

It is frequently necessary to keep objects coupled together, and to periodically release these objects from the coupled condition. For example, hinged doors and other closures may ordinarily be kept closed, but are opened periodically to afford access to the space sealed by the closure. Conventionally, rotatable hand operated latches may be provided to latch and unlatch a closure from its associated receptacle. However, rotatable latches typically have exposed projecting components which may become entangled with environmental objects, damaged, or lost.

In one example, the hood of a motor vehicle may require a latch which is readily actuated to release the hood for opening. Although passenger vehicles are conventionally provided with latches which engage automatically and which are manually released from the passenger cabin, supplementary latches have been provided for securing the hood. Typically, these latches utilize lanyards and other components which are susceptible to damage and loss due in part to the fact that they project upwardly above the hood surface. Environmental objects can easily become entangled with latch components, which may distort the latch and damage the environmental objects.

It would be desirable in situations such as that regarding exposed hood latches to provide a latch which may be essentially flush with the surface of its associated closure, and which is readily manually actuated. There exists a need for a potentially flushly mounted, manually actuated latch for latching two objects to one another and unlatching the same.

SUMMARY OF THE INVENTION

The present invention sets forth a latching arrangement which satisfied the above stated needs. The latching arrangement may comprise a large headed object which is fixed to an object, and a receptacle fixed to another object such as a closure, which releasably entraps the large head of the large headed object.

The large headed object may be entrapped by spherical objects such as ball bearings, which are retained in a surrounding collar bearing passages formed in the wall of the collar. In the latched condition, the ball bearings are so close to the enlarged head that they interfere with the ability of the large head to pass through the collar and escape therefrom.

A pushbutton assembly may telescopically encircle the collar. The pushbutton assembly may have an area displaying a constricted opening which holds the ball bearings in place in the interfering position, so as to assure interference with the enlarged head. Depressing the pushbutton assembly may expose the ball bearings to space into which the ball bearings may move, thereby moving out of the interfering position. The enlarged head may then drop out of engagement with the surrounding collar, with the consequence that the formerly latched objects are now unlatched.

The novel latching arrangement is particularly suited for securing a closure to a cabinet or compartment having an internal space which is closed by the closure. One particular example is for keeping the hood of a motor vehicle closed.

It is an object of the invention to provide a latch which may be manually depressed for actuation.

Another object of the invention is to provide a latch which may be formed substantially flush with an object to which it is attached.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
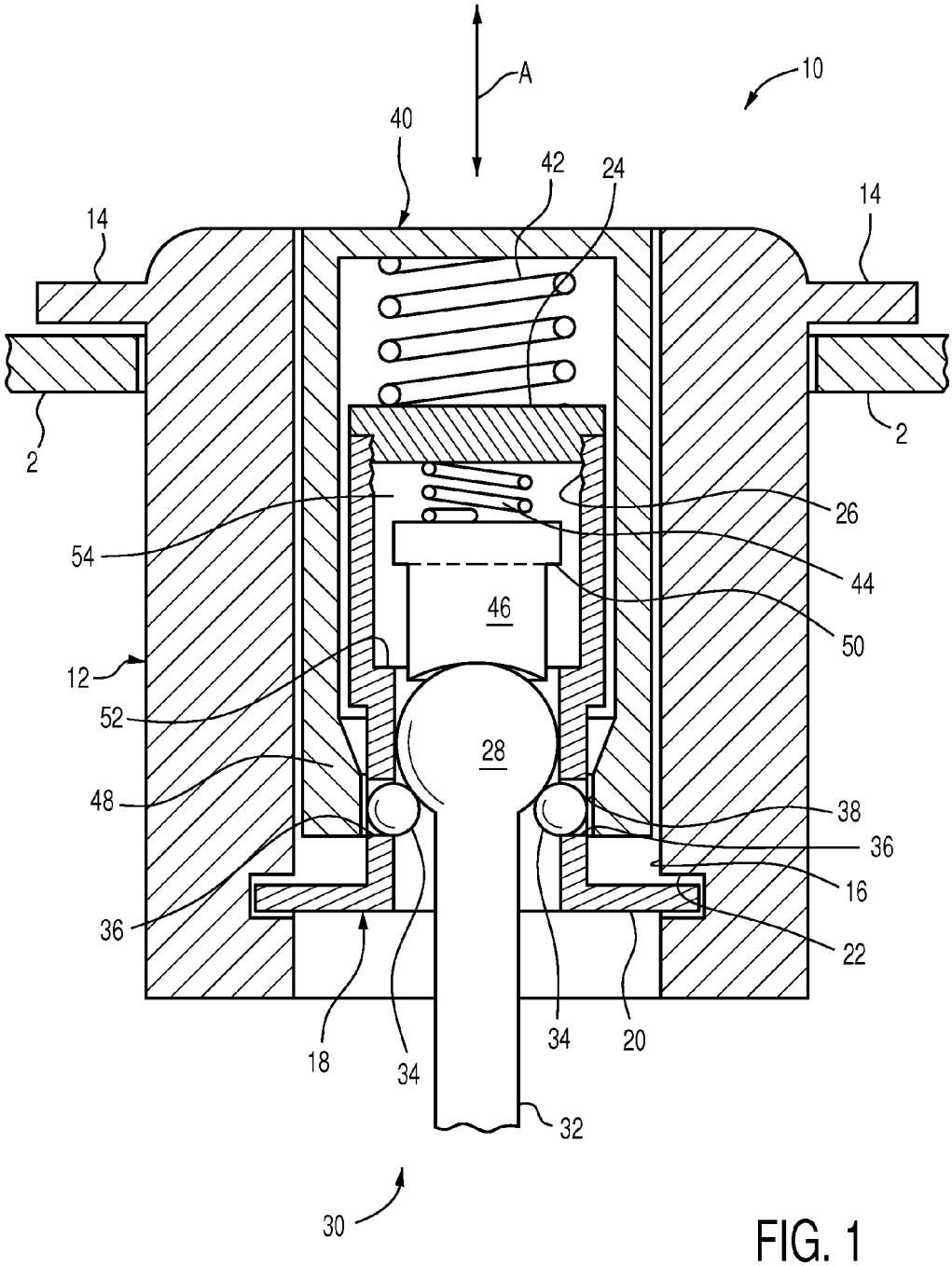
FIG. 1 is an environmental side view of a latch according to at least one aspect of the invention, showing the latched condition.

FIG. 1 shows a latch 10 according to at least one aspect of the invention. The latch 10 is shown seated on an environmental substrate 2. Although the latch is shown out of contact with the environmental substrate 2, it will be understood that ordinarily, the latch 10 will be suitably anchored to the environmental substrate 2, such as by using fasteners, adhesive, a heat bonding process such as welding, soldering, or brazing, or in any other suitable way, or any combination of these.

The latch 10 may be said to comprise stationary parts which are anchored to the environmental substrate 2, and moving parts. The stationary parts may include a housing 12 and a mounting flange 14. The housing 12 is a structural base to which other components of the latch 10 are fixed. The mounting flange 14 provides convenient structure for securing the latch 10 to the environmental substrate 2. The housing 12 has an internal space 16 for containing other components of the latch 10. One of these other components is a receptacle 18. Although depicted as a separate component, the receptacle 18 is fixed to the housing 12. Illustratively, the receptacle 18 may have a flange 20 which is received within a groove 22 formed in the housing 12. Although the housing 12 is depicted as being monolithic, it may be formed in several sections (not shown) which are suitably joined together such as by heat bonding, using fasteners, adhesives, or in other ways. This may be advantageous in that the groove 22 may be formed by space left when several sections are joined, thereby avoiding necessity of forming the groove 22 by molding, internal machining, or in some other way.

The receptacle 18 may be closed at its upper end by a threaded cap 24 which threads to threads 26 formed in the receptacle 18. It should be noted at this point that orientational terms such as upper and lower, left and right, and others refer to the drawings as viewed by an observer. Therefore, orientational terms must be understood to provide semantic basis for purposes of description, and do not limit the invention or its component parts in any particular way.

The lower section of the receptacle 18 entraps an enlarged head 28 of a large headed element 30 which may also comprise a stem 32. The stem 32 serves as a connector which is either directly or ultimately connected to an environmental element (not shown) to which the environmental substrate 2 is releasably coupled by the latch 10. For example, the environmental substrate 2 could be part of the hood of a passenger vehicle (not shown), while the stem 32 may be connected to a component of the engine compartment which is closed by the hood. It should be stated that the stem 32 is shown only in representative capacity, and may comprise a rigid member, a flexible member, or a combination of flexible and rigid members.

FIG. 1 illustrates the latched condition of the latch 10, wherein the enlarged head 28 is engaged by an interference element. The interference element may comprise one or more spherical objects such as ball bearings 34. The lower end of the receptacle 18 may comprise passages 36 each of which is dimensioned and configured to receive one ball bearing 34 in operable position for operating the latch 10. In the latched condition of FIG. 1, each ball bearing 34 is prevented from moving out of interfering relationship to the enlarged head 28 by an abutment surface 38 formed in the lower end of a pushbutton assembly 40. The pushbutton assembly 40 serves as a manual actuator which moves the ball bearings 34 out of interference with the enlarged head 28 when the manual actuator is linearly actuated, as will be described hereinafter. The pushbutton assembly 40 is held in the position shown in FIG. 1 by a return spring 42 which is biased to urge the pushbutton assembly 40 upwardly, as seen in FIG. 1. The return spring 42 is seated on the cap 24 which, it will be recalled, is among the stationary parts of the latch 10.

Figure 3:
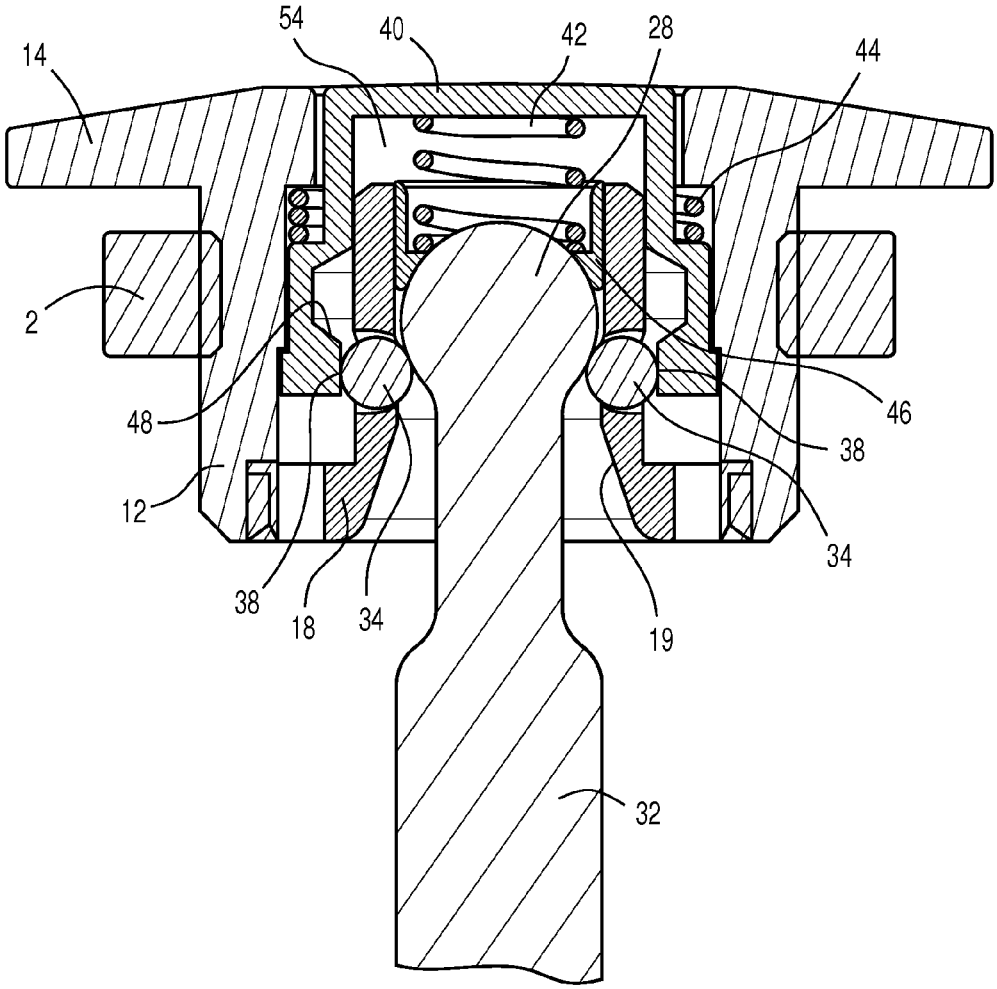
FIG. 3 is an environmental side view of a latch according to another aspect of the invention, showing the latched condition.
Figure 4:
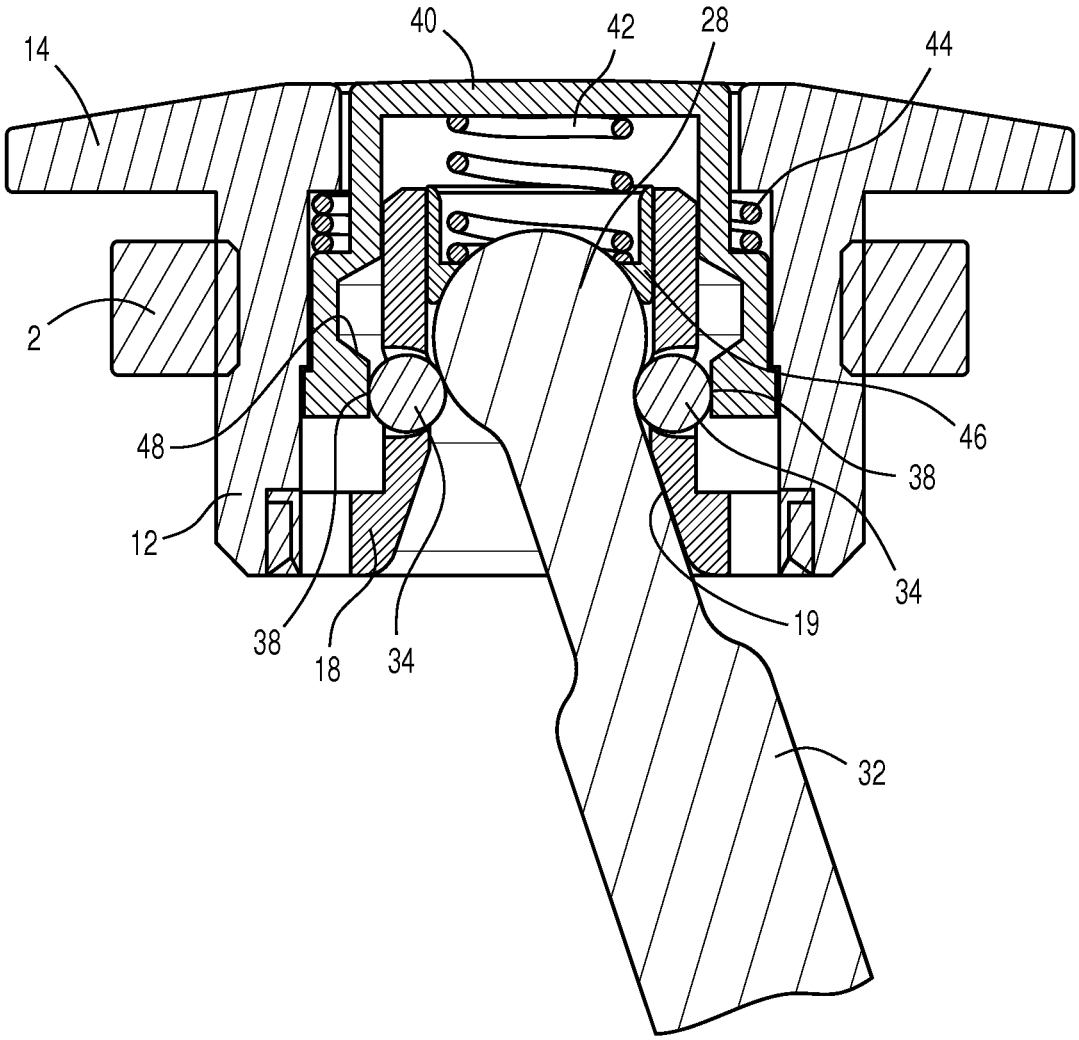
FIG. 4 is an environmental side view of a latch according to another aspect of the invention, showing the latched condition on a stem that is angled.

A pusher spring 44 seats on the lower surface of the cap 24, and is arranged to push on a locking piston 46. The locking 1 piston 46 constantly urges the enlarged head 28 downwardly, under the influence of the pusher spring 44. See also FIG. 3 showing a further embodiment of the latch of the present disclosure and FIG. 4, which shows how the latch of the present disclosure is capable of engaging the large headed element, which is the combination of the enlarged head 28 stem connector 32, that is positioned at an angle other than parallel to the vertical surfaces of the latch 10, said another way, at an angle other than parallel to operation axis A in FIG. 1. In FIG. 4, the sidewall 19 of receptacle 18 is tapered to allow for the clearance of the large headed element when it enters at an angle other than parallel to the vertical surfaces of the latch.

Figure 2:
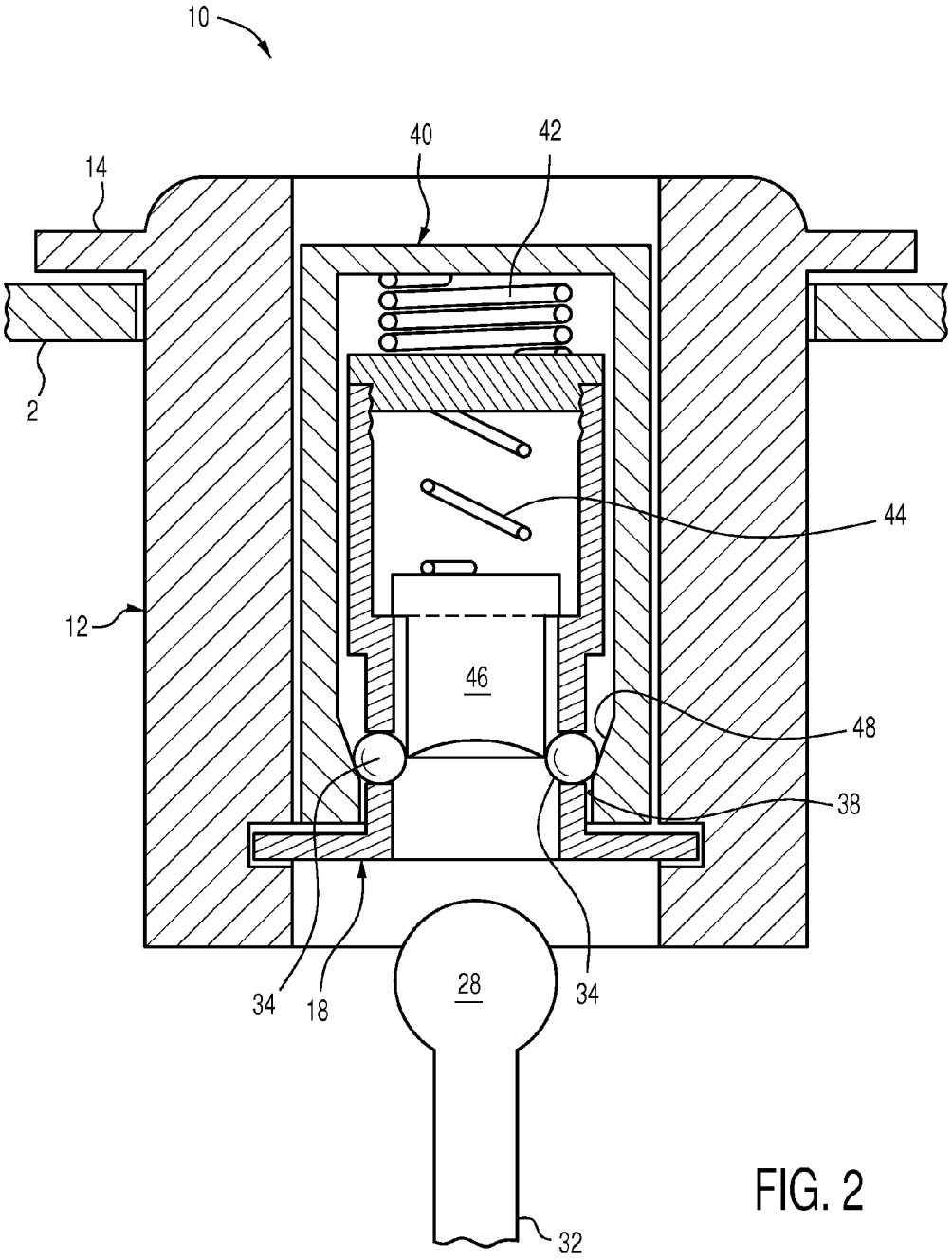
FIG. 2 is similar to FIG. 1, but shows the unlatched condition.
Figure 5:
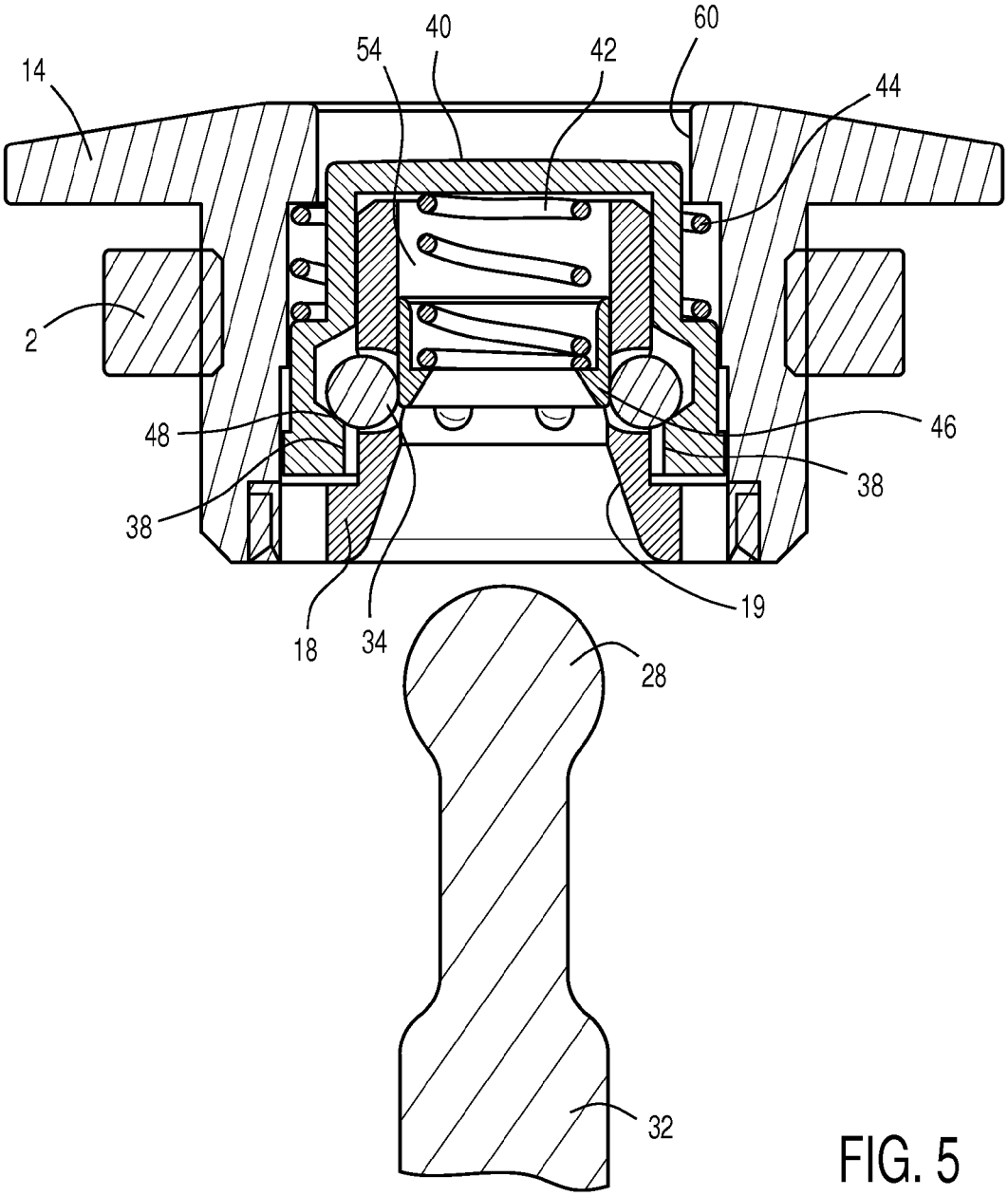
FIG. 5 is similar to FIG. 3, but shows the unlatched condition.

Turning now to FIGS. 2 and 5, linear actuation occurs when the pushbutton assembly 40 is depressed downwardly. This motion has several consequences. It will be seen that the abutment surface 38 has moved out of the abutting relationship with the ball bearings 34 it exhibited in FIG. 1. Instead, a relief space is provided by a beveled surface 48, which is radially recessed compared to the abutment surface 38. The enlarged head 28, urged downwardly by the locking piston 46 and the pusher spring 44, in turn displaces the ball bearings 34 outwardly such that the ball bearings 34 now occupy the relief space. This may be called a retraction arrangement which moves the ball bearings 34 into the relief space responsively to the pushbutton assembly 40 being linearly moved.

Once occupying the relief space, the ball bearings 34 release the enlarged head 28 from interference therewith, due to the linear motion of the pushbutton assembly 40. Once the user's finger is removed, the pushbutton assembly 40 will be moved upwardly to the position it occupied in FIG. 1 due to expansion characteristics of the return spring 42.

Some components of the housing 12 have been described as moving upwardly and downwardly, such as the pushbutton assembly 40 and the locking piston 46, this being seen by comparing FIGS. 1 and 2. Also, the return spring 42 expands and contracts in the same directions. These directions may be called an axis of operation (represented by an arrow A) for semantic purposes. The components of the housing 12 which are movable along the axis of operation A include the locking piston 46, which is disposed within the open interior 54 of the receptacle 18, and the pushbutton assembly 40, which is entrapped between the housing 12 and the receptacle 18. Also, comparison of FIGS. 1 and 2 will also reveal that the return spring 42, which is located between the threaded cap 24 of the receptacle 18 and the top of the pushbutton assembly 40, and the pusher spring 44 which is disposed within the open interior 54 of the receptacle 18, expand and contract along the axis of operation A.

Further, when the push button assembly is pressed, which allows sloped edge 48 to move downward so as to release retaining ball 34 which holds the underside of the ball latch 28. Once the latch is released, locking piston 46 is pushed downward by spring 44 where the edges of the locking piston 46 block the retaining ball 34 in the outward position so as to hold the sloped edge 48 of push button 40 in the downward position. This in turn holds the button 40 in the downward position giving the operator visual indication that the latch is locked in the open position. The visual indication can be a painted ring 60 around the interior on of the mounting flange 14 (see FIG. 5) or other visual indicator.

When the ball latch is reintroduced to the lower face locking piston 46, the edge of the locking piston 46 is moved upward releasing the retaining balls 34 from its influence. Once the ball latch 28 is moved into proper position, the retaining balls 34 move inward under the latch area which releases the sloped area 48, whereby the push button 40 moves up under the influence of spring 42 into the latched position shown in FIG. 1. The inner sidewall 38 of the push button 40 holds the retaining balls 38 securely inward and under the ball latch 28. Further, the latch is lockable in an open position when the actuator is held in a downward configuration.

It will also be seen that as the pushbutton assembly 40 is depressed, the locking piston 46 descends sufficiently to obstruct the ball bearings 34 from falling out of the relief space in the absence of the enlarged head 28. Removal of interference formerly provided by the ball bearings 34 enables the enlarged head 28 and the stem 32 of the large headed element 30 to be released by the latch 10. The locking piston 46 is constrained against loss by interference between a shoulder 50 formed in the locking piston 46 with a ledge 52 formed in the receptacle 18. The shoulder 50 and the ledge 52 are called out in FIG. 1.

In summary, the receptacle 18 selectively entraps the enlarged head 28 within the receptacle 18 by interference and releases the enlarged head 28 from entrapment within the receptacle 18. The receptacle 18 has an interference element which engages the enlarged head 28 of the large headed element 30 with an exposed manual actuator in the form of the pushbutton assembly 40, actuation of which enables the interference element to release the enlarged head 28 from interference therewith by linear action. To do this manual actuator or pushbutton assembly 40 comprises an abutment surface 38 disposed to engage the interference element and retain the interference element in interfering relationship relative to the enlarged head 28.

A relief space is disposed to enable the interference member to move out of the interfering relationship shown in FIG. 1 when the manual actuator is linearly moved such that the abutment surface 28 disengages from the interference element. Simultaneously, the relief space comes into alignment with the interference element, thereby enabling the interference element to withdraw from the interfering relationship with the enlarged head 28 as seen in FIG. 1, and enabling the enlarged head 28 to move out of engagement with the receptacle 18, as seen in FIG. 2.

The latch 10 is quite compact due to the telescopic engagement of the pushbutton assembly 40 with the receptacle 18 as the former passes through the internal space 16 of the housing 12, and over the receptacle 18.

A lock such as a key lock may be incorporated into the latch 10 if desired so that unauthorized depression of the pushbutton assembly 40 is prevented.

The present invention is susceptible to modifications and variations which may be introduced thereto without departing from the inventive concepts. For example, although the invention has been described with respect to the flange 14 being provided for mounting the housing 12 to the environmental substrate 2, other mountings could be substituted thereof. In such an occurrence, the flange 14 could comprise a trim ring, or may be deleted altogether. Further, it should be appreciated that the latch can include a keyed lock mechanism to lock the latch in a locked or unlocked position.

It will be appreciated that the present invention has application to objects other than vehicle hoods. Windows for ships and boats, trailers, aircraft, houses and other objects may utilize the invention. Closures for furniture, vehicles, buildings, sheds, cabinets, furniture, boxes and other articles may utilize the invention. Closures may be of the swinging or hinged type, or may move linearly. For example, drawers may be released and latched using the invention.

In the same vein, there is no reason to limit applicability of the invention to closures. The invention may be used to secure any object to another object. In that regard, the invention may be considered as a re-establishable separation of a link bearing an enlarged head from an object which engages that enlarged head by interference.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A latch for coupling a first object to a second object and capable of moving from an engaged to disengaged position along an axis of operation, the latch comprising:

a large headed element including an enlarged head and a connector projecting from the enlarged head;

a housing having an internal space extending entirely therethrough along an axis of operation;

a receptacle, having an open interior and an interference element, wherein the receptacle is fixed to the housing, and the receptacle is received within the internal space of the housing, wherein when the latch is in the engaged position, the receptacle is disposed selectively to entrap the enlarged head of the large headed element within the receptacle by the interference element, and when the latch is in the disengaged position, the receptacle is disposed to release the enlarged head of the large headed element from entrapment within the receptacle;

a push button assembly which serves as a manual actuator to disengage the latch by enabling the interference element to release the enlarged head of the large headed element from interference therewith by linear action, wherein the push button assembly includes a return spring disposed between the pushbutton assembly and the receptacle so that the return spring is able to expand and contract along the axis of operation when the latch moves between the engaged and disengaged positions, wherein the enlarged head of the large headed element is separate from the housing and releasably entrapped within the receptacle; and a locking piston disposed within the open interior of the receptacle and disposed to move along the axis of operation, wherein when the latch is disengaged by depressing the manual actuator of the push button assembly, a pusher spring, disposed within the open interior of the receptacle between the receptacle and the locking piston, and disposed to expand and contract along the axis of operation, expands thereby forcing the locking piston to move along the axis of operation and eject the enlarged head of the large headed element from the receptacle and into a position to maintain contact with the interference element thereby allowing the reinsertion of the enlarged head of the large headed element into the receptacle when the latch is in the disengaged position.

2. The latch according to claim 1, wherein the interference element comprises at least one spherical object, and the receptacle comprises at least one passage which enables the at least one spherical object to move out of interference with the enlarged head when the manual actuator is actuated.

3. The latch according to claim 1, wherein the manual actuator comprises an abutment surface disposed to engage the interference element and retain the interference member in interfering relationship relative to the enlarged head, and a relief space disposed to enable the interference member to move out of the interfering relationship when the manual actuator is linearly moved such that the abutment surface disengages from the interference element and the relief space comes into alignment with the interference element, thereby enabling the interference element to withdraw from interfering relationship with the enlarged head of the large headed element and to enable the enlarged head to move out of engagement with the receptacle.

4. The latch according to claim 1, wherein the manual actuator telescopically engages the receptacle.

5. The latch according to claim 3, further comprising a retraction arrangement disposed to move the interference element into the relief space responsively to the manual actuator being linearly moved.

6. The latch according to claim 1, further comprising indication means to indicate whether the latch is engaged or not.

7. The latch according to claim 6, wherein the indication means is a colored ring.

8. The latch according to claim 1, further comprising keyed locking means to lock the latch in a latched position.

9. The latch according to claim 1, further comprising keyed locking means to lock the latch in an unlatched position.

10. The latch according to claim 1, wherein said latch can engage a large headed element that is positioned at an angle other than parallel to the vertical surfaces of the latch.

11. The latch according to claim 1, wherein the sole insertion of the enlarged head of the large headed element into the receptacle of the disengaged latch converts the latch to the engaged position, thereby retaining the enlarge head of the large headed element within the receptacle.

12. A latch for coupling a first object to a second object and capable of moving from an engaged to disengaged position along an axis of operation, the latch comprising:

a large headed element including an enlarged head and a connector projecting from the enlarged head;

a receptacle, having an open interior and an interference element, wherein when the latch is in the engaged position, the receptacle is disposed selectively to entrap the enlarged head of the large headed element within the receptacle by the interference element and when the latch is in the disengaged position, the receptacle is disposed to release the enlarged head of the large headed element from entrapment within the receptacle;

a manual actuator button which when depressed enables the interference element to release the enlarged head of the large headed element from interference therewith by linear action such that the large headed element can be removed from the receptacle; and a locking element disposed within the open interior of the receptacle and disposed to move along the axis of operation, wherein when the latch is disengaged by depressing the manual actuator button, a pusher spring, disposed within the open interior of the receptacle between the receptacle and the locking element, and disposed to expand along the axis of operation, expands thereby forcing the locking piston to move along the axis of operation into a position to maintain contact with the interference element thereby allowing the reinsertion of the enlarged head of the large headed element into the receptacle when the latch is in the disengaged position.

13. The latch according to claim 12, wherein the interference element comprises at least one spherical object, and the receptacle comprises at least one passage which enables the at least one spherical object to move out of interference with the enlarged head when the manual actuator is actuated.

14. The latch according to claim 12, wherein the manual actuator comprises an abutment surface disposed to engage the interference element and retain the interference member in interfering relationship relative to the enlarged head, and a relief space disposed to enable the interference member to move out of the interfering relationship when the manual actuator is linearly moved such that the abutment surface disengages from the interference element and the relief space comes into alignment with the interference element, thereby enabling the interference element to withdraw from interfering relationship with the enlarged head of the large headed element and to enable the enlarged head to move out of engagement with the receptacle.

15. The latch according to claim 12, wherein the manual actuator telescopically engages the receptacle.

16. The latch according to claim 14, further comprising a retraction arrangement disposed to move the interference element into the relief space responsively to the manual actuator being linearly moved.

17. The latch according to claim 12, further comprising indication means to indicate whether the latch is engaged or not.

18. The latch according to claim 17, wherein the indication means is a colored ring.

19. The latch according to claim 12, further comprising keyed locking means to lock the latch in a latched position.

20. The latch according to claim 12, further comprising keyed locking means to lock the latch in an unlatched position.

21. The latch according to claim 12, wherein said latch can engage a large headed element that is positioned at an angle other than parallel to the vertical surfaces of the latch.

22. The latch according to claim 12, wherein the sole insertion of the enlarged head of the large headed element into the receptacle of the disengaged latch converts the latch to the engaged position, thereby retaining the enlarge head of the large headed element within the receptacle.

* * * * *